United States Patent [19]

Pobst

[11] 4,292,024

[45] Sep. 29, 1981

[54] METHOD OF AND APPARATUS FOR BURNING WET LEAN GAS

[75] Inventor: David F. Pobst, Houston, Tex.

[73] Assignee: Sid Richardson Carbon & Gasoline Company, Forth Worth, Tex.

[21] Appl. No.: 104,961

[22] Filed: Dec. 18, 1979

[51] Int. Cl.[3] ..... F27B 15/00; F27B 7/08

[52] U.S. Cl. ..... 432/13; 252/421; 423/460; 431/5

[58] Field of Search ..... 432/13, 112; 431/337, 431/338, 5; 252/421; 423/449, 450, 460, 461

[56] References Cited

U.S. PATENT DOCUMENTS

| | | | |
|---|---|---|---|
| 3,207,201 | 9/1965 | Zink et al. | 431/5 |
| 3,269,165 | 8/1966 | Anderson | 239/566 X |
| 3,277,948 | 10/1966 | Best | 431/328 |
| 3,291,115 | 12/1966 | Forniti | 431/328 |
| 4,122,036 | 10/1978 | Lewis | 252/421 |

*Primary Examiner*—John J. Camby

*Attorney, Agent, or Firm*—Vinson & Elkins

[57] ABSTRACT

An improved method and apparatus for burning leaner lean wet gas wherein the gas is mixed with an oxidant gas and uniformly distributed to the face of a burner assembly composed of a plurality of parallel positioned, spaced-apart elongated members, defining a plurality of relatively narrow slots through which the gas mixture flows and igniting the gas mixture as it exits from these slots. This improved burner can be used in the manufacture of certain grades of carbon black to provide heat to the carbon black pellet dryer by burning the by-product gases produced in the carbon black reactor.

10 Claims, 5 Drawing Figures

FIG. 1
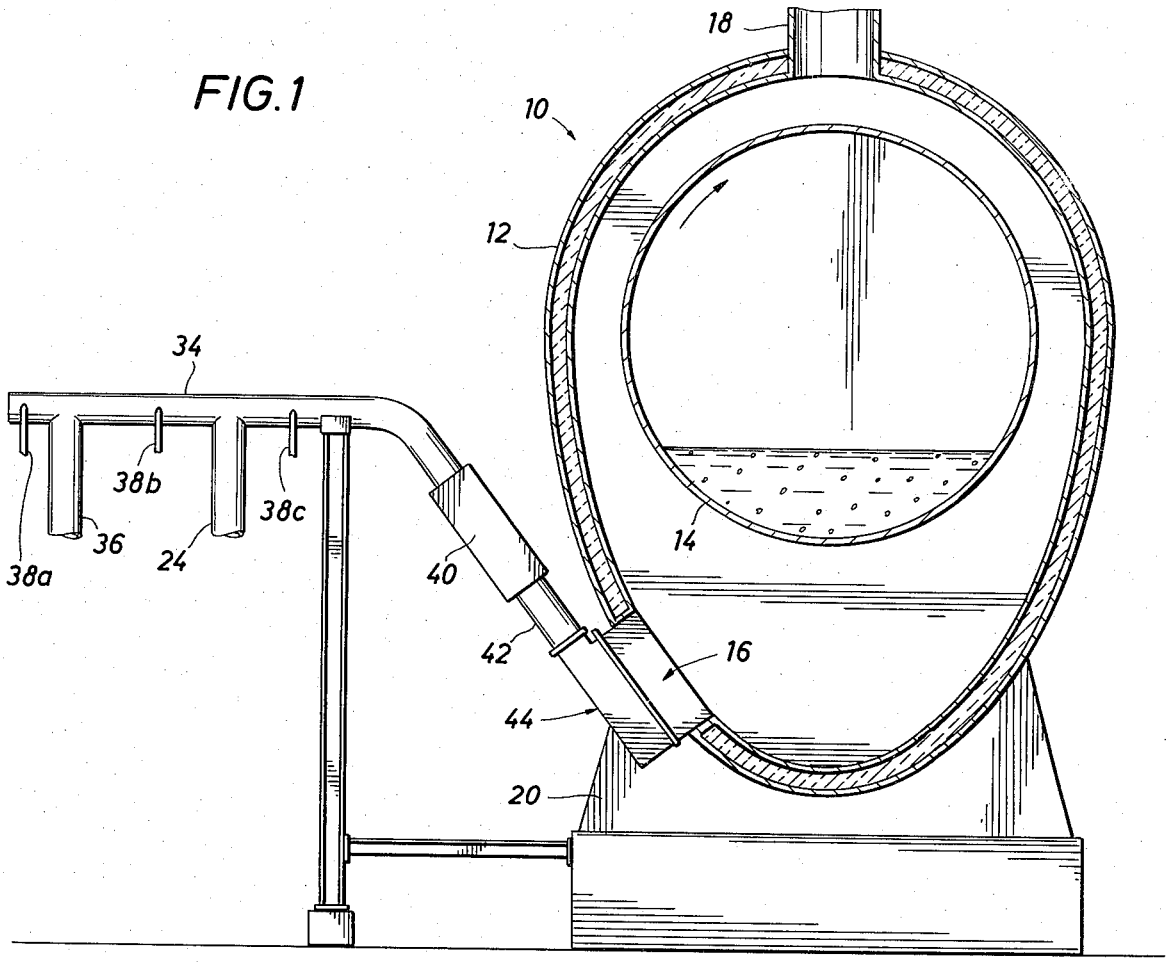
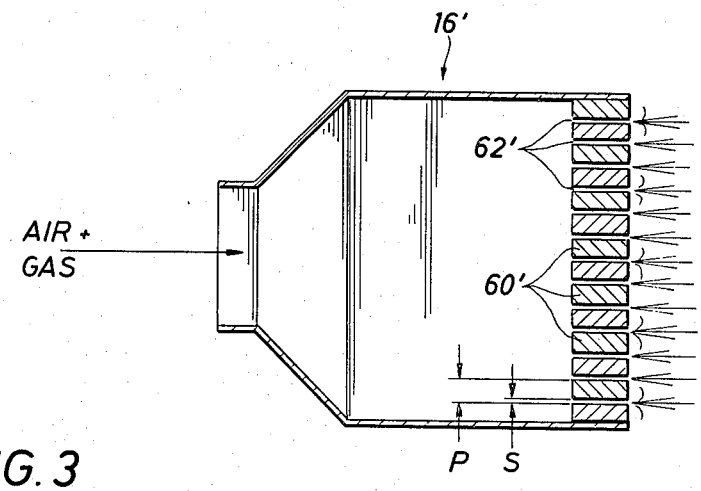
FIG. 3

FIG. 4
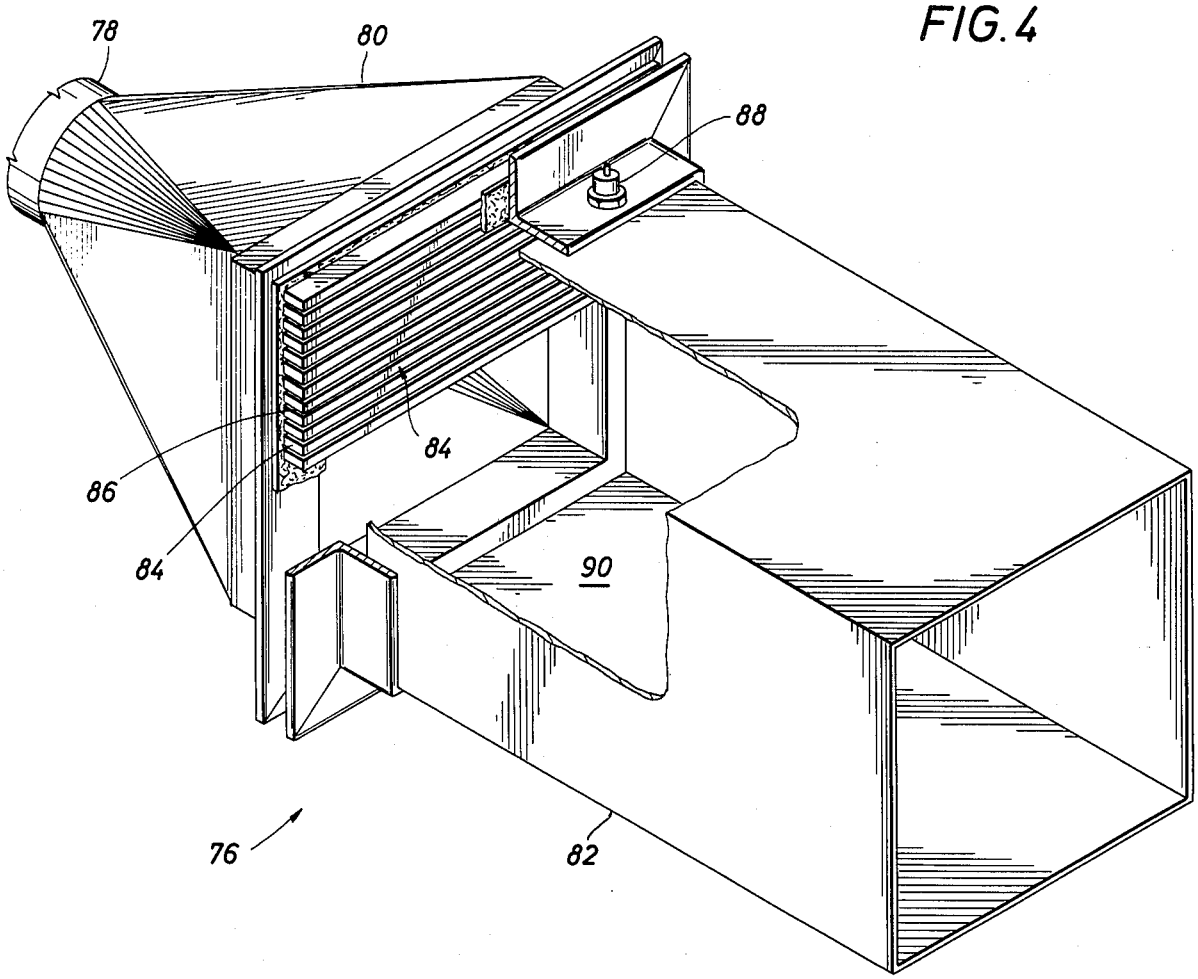
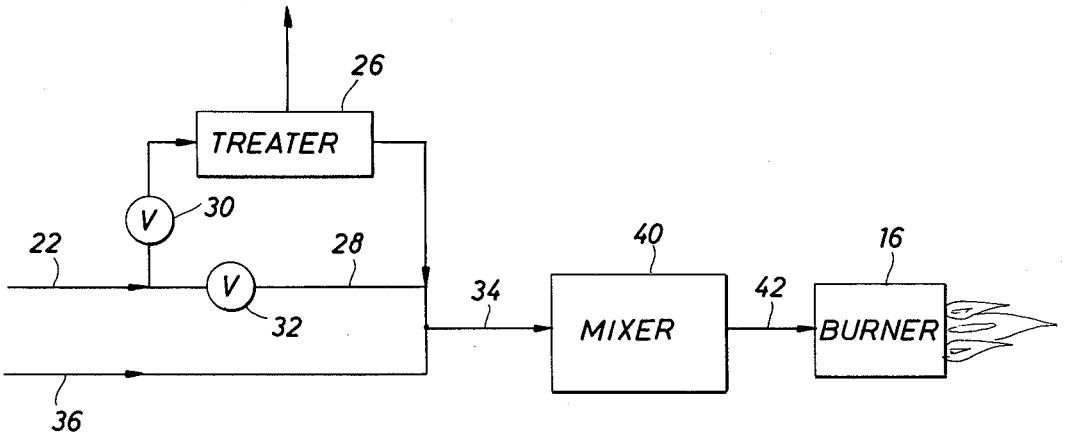
FIG. 5

METHOD OF AND APPARATUS FOR BURNING WET LEAN GAS

BACKGROUND OF THE INVENTION

Prior to the present invention, combustion of lean gas and lean wet gas has been accomplished only with expensive equipment and most often very inefficiently. Low heat value gas is generally specified to have a heating value of approximately 150 Btu per cubic foot. Lean gas as contemplated herein may have a heating value as low as 35 to 90 Btu per cubic foot and some types of lean gas have a moisture content up to 45% by volume or higher.

A typical example of the expensive and complicated structures which have been suggested for the combustion of lean gases is shown in the French patent application of Continental Carbon Company, No. 7732829 based on patent application Ser. No. 757,532 filed in the United States by Karel R. Dahmen on Jan. 7, 1977, now U.S. Pat. No. 4,154,567. This application discloses an internal vane structure to create a vortex flow of the lean gas and also a swirling of the gases supplied to the auxiliary combustion supporting burner.

The L. P. Hine, Jr., et al U.S. Pat. No. 3,285,317 discloses a burner purporting to be a universal burner suitable for any type of gas and of relatively inexpensive sheet metal construction. The burner includes an elongate dished portion with a plurality of rows of slots therein with the slots nearest the manifold being of smaller width than the slots at the other end of the burner. Efforts to purchase a burner from the owners of this patent suitable for the burning of lean gases as defined above were not successful.

Others have suggested the use of slots in a burner but none have claimed to be able to burn lean wet gas. Examples of such prior structures are disclosed in U.S. Pat. No. 1,830,393 to B. A. Geurink et al (corrugated burner plate with slots at peak of corrugation ridges), U.S. Pat. No. 3,361,367 to G. Hein et al (alternating parallel long and short slots in burner plate) and U.S. Pat. No. 2,443,101 to J. H. Flynn et al (ribbon burner having two different size ports). The W. Flaskamp et al U.S. Pat. No. 3,106,955 discloses a vortex type of burner with a plurality of slots for entry of the air into the burner.

SUMMARY

The present invention relates to an improved method of and apparatus for the combustion of lean, wet gas, such as wet by-product gases discharged from a furnace carbon black process in the manufacture of carbon black ASTM commercial grades N-351 and N-220. The improved method of the present invention includes the steps of adding an oxidant gas, such as air, to the lean gas, flow the gases through a flow divider to and through a plurality of slots defined between a plurality of parallel positioned elongate members and igniting the gases flowing from the slots. The improved apparatus of the present invention includes a supply of lean gas and a supply of oxidant gas connected to a mixer for the gases, a flow divider delivering gases to a burner having a plurality of slots through which the mixed gases flow, which slots are defined between a plurality of parallel positioned elongated bars and ignition means for igniting the mixed gases flowing from the slots.

An object of the present invention is to provide an improved method of and apparatus for burning lean, wet gas which is simple and effective.

Another object is to provide an improved method of burning lean wet gas which is a by-product from a furnace carbon black process to supply heat to the carbon black pellet dryer.

A further object is to provide an improved burner for the combustion of lean wet fuel gas which requires a minimum of space and relative simple apparatus.

BRIEF DESCRIPTION OF THE DRAWINGS

These and other objects and advantages are hereinafter set forth and explained with reference to the drawings wherein:

FIG. 1 is an elevation view of a dryer having the improved burner of the present invention.

FIG. 3 is a simplified diagrammatic view to illustrate the size ratios and combustion in the improved burner of the present invention.

FIG. 4 is an isometric view of a modified form of improved burner with portions broken away to show internal construction.

FIG. 5 is a schematic diagram showing an alternate form including a treating step for the lean wet gas.

DESCRIPTION OF THE PREFERRED EMBODIMENT

Figure 2:
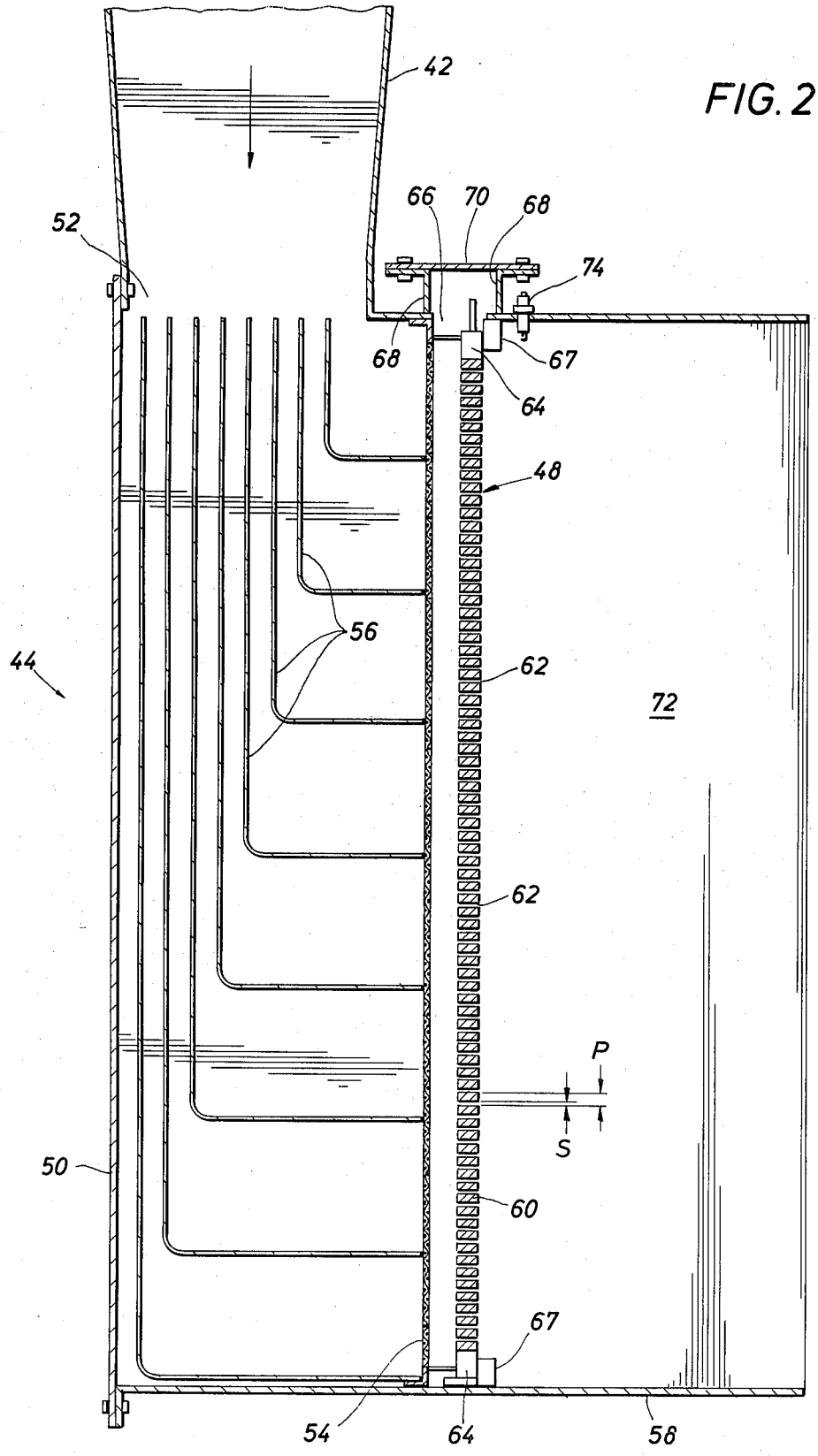
FIG. 2 is a detail sectional view of the improved burner of the present invention.

Dryer 10 shown in FIG. 1 is a rotary drum dryer used to dry carbon black pellets. Dryer 10 includes refractory lined shell 12, rotating drum 14, burner 16 and stack 18 all mounted on a suitable support 20. The lean, wet gas, such as the gas discharged from a furnace carbon black process during the manufacture of carbon black commercial ASTM grades N-351 and N-220 is supplied through line 22. As shown schematically in FIG. 5, the gas may flow from line 22 to line 24 through treater 26 wherein water separation or sulfur removal from the gas is provided or it may flow through by-pass line 28 to line 24 depending on the setting of valves 30 and 32. The lean, wet gas is conducted through treater 26 when some treatment of the gas is believed to be beneficial prior to burning. For example, sulfur bearing compounds or excess moisture may be removed in treater 26 by known and relatively simple treatments. Line 24 connects to manifold 34. An oxidant gas, such as air, is delivered to manifold 34 through line 36. Supplemental or enrichment fuel may be supplied through one or more of lines 38*a*, 38*b* and/or 38*c*.

The combined stream of gas flows through manifold 34 to mixer 40, which is of any suitable type, to assure that all of the gases are thoroughly mixed. The mixed gases are conducted through line 42 to flow distributor 44 which is shown in detail in FIG. 2. Flow distributor 44 splits the flow of mixed gases into a plurality of substantially equal portions which are delivered to burner 16 to assure substantially equal flow to all portions of burner grid assembly 48.

Flow distributor 44 includes housing 50 with inlet 52 connecting to line 42 and with outlet 54 which is in direct communication with burner 16 and dividers 56 which form a plurality of substantially equal sectional area passages extending from inlet 52 to outlet 54 and causes the gases to turn at an angle of 90° to its flow direction at inlet 52. Preferably, dividers 56 do not create turbulence but rather to provide a smooth flow of gases entering burner 16.

Burner 46 includes housing 58 secured to distributor housing 44, burner assembly 48 having a plurality of parallel positioned elongate members or bars 60 with slots 62 therebetween supported on frame 64. Bars 60 are preferably stainless steel. Bars 60 are secured as by welding or other suitable means, to frame 64. Opening 66 in burner 46 is provided for the removal and installation of burner assembly 48. Suitable brackets 67 support burner assembly 48 within housing 58. Flanges 68 surround opening 66 and plate 70 is removably secured to flanges 68 to close opening 66. Combustion chamber 72 is downstream of bars 60 within housing 58 and in communication with the heating chamber in dryer 10 surrounding drum 14. Suitable ignition means such as spark plug 74, is positioned within combustion chamber 72 to ignite the mixed gases entering chamber 72.

The gases flowing from slots 62 are ignited and burn within combustion chamber 72 without the use of refractories. The products of combustion flow around rotating drum 14 within shell 12 to heat and dry the pellets within drum 14. The spent gases are exhausted from dryer through stack 18.

It is believed that the stable combustion of lean wet gas is obtained by the improved burner of the present invention because the plane parallel jets issuing from the slots establish a recirculatory flow between the jets which effectively establishes a return flow of downstream hot species to the jet bases where they are entrained and heat the issuing mixed gases to ignition.

FIG. 3 schematically illustrates a simplified burner 16' having a plurality of parallel positioned elongate members 60' spaced apart a preselected distance to define slots 62'. The arrows in FIG. 3 illustrate the above mentioned recirculatory flow. To obtain the most efficient combustion, it is believed that the ratio between the slot widths S and the pitch P of the slots (the slot width plus the bar width) should be optimized as hereinafter set forth.

A test burner was constructed substantially as shown in FIG. 4. Burner 76 included duct 78 connecting to transition section 80 which connects to burner housing 82. The burner assembly 84 includes a plurality of elongate stainless steel bars 86 ($\frac{1}{4}'' \times \frac{3}{4}'' \times 12''$) installed on frame 85 within housing 82. The width of slots 86 was varied in test runs, being 0.025 inches in some runs and 0.060 inches in other runs. Ignition was achieved with spark plug 88 mounted in housing 82 close to the outlet of slots 86 and combustion took place within combustion chamber 90.

Tables I and II illustrate the lean, wet gas composition which were used in the tests on burner 76.

TABLE I

| Component | Vol. % |
|---|---|
| $H_2$ | 8.82 |
| A | 0.50 |
| $N_2$ | 37.95 |
| $CH_4$ | 0.71 |
| CO | 7.16 |
| $CO_2$ | 2.26 |
| $C_2H_2$ | 0.60 |
| $H_2O$ | 42.0 |
| Total | 100.00 |

Net heating value, wet basis = 62.3 Btu/ft$^3$
Net heating value, dry basis - 107.4 Btu/ft$^3$
Stoichiometric volume ratio, air/wet lean gas - 0.52

TABLE II

| Component | Vol. % |
|---|---|
| $H_2$ | 7.473 |
| A | 0.51 |
| $N_2$ | 35.367 |
| $CH_4$ | 0.122 |
| CO | 7.219 |
| $CO_2$ | 2.178 |
| $C_2H_2$ | 0.122 |
| $H_2O$ | 47.0 |
| Total | 100.0 |

Net heating value, wet basis - 47 Btu/ft$^3$
Net heating value, dry basis - 87.9 Btu/ft3
Stoichiometric volume ratio, air/wet lean gas = $^{0.38}$ Table III gives the results of those tests. In Runs 1 through 7 the slot width was 0.025" and the slot to pitch ratio was 9.09%. In runs 8 through 23 the slot width was 0.060" and the slot to pitch ratio was 19.35%. The lean gas set forth in Table I was used in Runs 1–7 and 11–23 and the lean gas set forth in Table II was used in Runs 8, 9 and 10. Burner assembly opening size was 12"×12" in all runs but Runs 21, 22 and 23 where it was changed to $12\frac{3}{8}'' \times 7\frac{3}{8}''$. Bars 84 were $\frac{3}{4}'' \times \frac{1}{4}''$ stainless steel of suitable length for the burner face size.

TABLE III

| RUN NO. | SLOT/PITCH RATIO, % | ΣSLOT AREA, in.$^2$ | SLOT VELOCITY, fps | PREMIX TEMP., °F. | LEAN GAS FLOW, scfh | AIR FLOW, scfh | AIR/LEAN GAS VOLUME RATIO | FLAME TEMP., °F. | BURNER ΔP. "$H_2O$ |
|---|---|---|---|---|---|---|---|---|---|
| 1 | 9.09 | 13.09 | 77.6 | 310 | 9334 | 6434 | 0.69/1 | 1650 | — |
| 2 | 9.09 | 13.09 | 73.1 | 340 | 7225 | 7068 | 0.98/1 | 1220 | — |
| 3 | 9.09 | 13.09 | 70.0 | 355 | 5815 | 7612 | 1.31/1 | 460 | — |
| 4 | 9.09 | 13.09 | 73.7 | 360 | 6761 | 7306 | 1.08/1 | 840 | — |
| 5 | 9.09 | 13.09 | 26.5 | 320 | 3039 | 2273 | 0.75/1 | 1430 | — |
| 6 | 9.09 | 13.09 | 19.1 | 380 | 1638 | 1903 | 1.16/1 | 900 | 0.35 |
| 7 | 9.09 | 13.09 | 72.1 | 380 | 8628 | 4835 | 0.56/1 | 1500 | 2.35 |
| 8 | 19.35 | 27.87 | 43.7 | 390 | 10242 | 6823 | 0.67/1 | 1385 | 0.20 |
| 9 | 19.35 | 27.87 | 23.8 | 370 | 5955 | 3934 | 0.66/1 | 1320 | <0.10 |
| 10 | 19.35 | 27.87 | 28.4 | 370 | 7458 | 3918 | 0.53/1 | 1380 | <0.10 |
| 11 | 19.35 | 27.87 | 43.2 | 420 | 9988 | 6312 | 0.63/1 | 1510 | 0.15 |
| 12 | 19.35 | 27.87 | 9.4 | 400 | 1616 | 2028 | 1.25/1 | 1300 | <0.10 |
| 13 | 19.35 | 27.87 | 41.5 | 380 | 11372 | 5033 | 0.44/1 | 790 | 0.10 |
| 14 | 19.35 | 27.87 | 42.9 | 410 | 9944 | 6439 | 0.65/1 | 1550 | 0.15 |
| 15 | 19.35 | 27.87 | 54.2 | 395 | 13560 | 7568 | 0.56/1 | 1680 | 1.30 |
| 16 | 19.35 | 27.87 | 56.2 | 360 | 13890 | 8966 | 0.64/1 | 1670 | 1.50 |
| 17 | 19.35 | 27.87 | 56.9 | 355 | 15263 | 7989 | 0.52/1 | 1600 | 1.45 |
| 18 | 19.35 | 27.87 | 57.0 | 385 | 14660 | 7845 | 0.54/1 | 1520 | 1.55 |
| 19 | 19.35 | 27.87 | 48.0 | 425 | 8331 | 9754 | 1.17/1 | 1130 | 1.35 |
| 20 | 19.35 | 27.87 | 49.9 | 360 | 16447 | 3863 | 0.23/1 | 1000 | 1.65 |
| 21 | 19.35 | 18.14 | 68.0 | 360 | 10903 | 7233 | 0.66/1 | 1610 | 4.63 |

TABLE III-continued

| RUN NO. | SLOT/PITCH RATIO, % | ΣSLOT AREA, in.$^2$ | SLOT VELOCITY, fps | PREMIX TEMP., °F. | LEAN GAS FLOW, scfh | AIR FLOW, scfh | AIR/LEAN GAS VOLUME RATIO | FLAME TEMP., °F. | BURNER ΔP. "$H_2O$ |
|---|---|---|---|---|---|---|---|---|---|
| 22 | 19.35 | 18.14 | 64.6 | 400 | 9881 | 6607 | 0.66/1 | 1650 | 6.00 |
| 23 | 19.35 | 18.14 | 59.0 | 365 | 8584 | 6921 | 0.81/1 | 1640 | 1.22 |

In run #1 a plot of the flame temperature along the length of combustion chamber 82 established that the highest temperature was reached within 18½ inches downstream of the burner slot structure which shows that combustion was substantially complete before reaching the end of combustion chamber 82 which was 26 inches long. Continuous combustion was achieved in each of the runs without the addition of enrichment fuel.

It has been found that an increase of water vapor content above a particular point, sometimes above 50% by volume, noticeably decreases flame stability. Stability may be achieved by increasing the temperature of the premix, by enrichment, by a combination of premix temperature increase and enrichment or by removal of some water vapor from the gas. There is no way to predict this point. However, the lean, wet gases tested as set forth above gave eminently satisfactory burning. Optimum performance is obtained when the lean gas and oxidant gas are premixed and distributed uniformly to the burner bar slot assembly.

The three runs set forth in Table IV were made with the improved burner of the present invention. Utilizing lean gas from the production of carbon black, ASTM grades, N-339 and N-220, the combustion of these gases with air was used to heat pellets of carbon black in a rotary drum dryer substantially as shown in FIG. 1.

TABLE IV

| RUN | A | B | C |
|---|---|---|---|
| GRADE of Carbon Black Made | N-339 | N-339 | N-220 |
| AIR, SCFH, all burners | 289,565 | 222,145 | 250,105 |
| Lean Gas SCFH, all burners | 738,690 | 796,220 | 677,790 |
| Premix Temp. °F. | 400 | 400 | 380 |
| Natural Gas Enrichment, SCFH | 0 | 624 | 0 |
| Dryer Bed Temperature, °F. | 425 | 480 | 475 |
| Avg. Flame Temperature, °F. | 1,524 | 1,577 | 1,271 |
| Water Evaporated, #/hr. | 4,640 | 4,640 | 3,590 |
| Carbon Black Dried, #/hr. | 4,280 | 4,280 | 3,315 |

As can be seen from Table IV above, these lean, wet by-product gases from a carbon black process which previously were waste gases, were successfully burned and performed the useful function of drying substantial quantities of carbon black pellets. It should be noted that in Run B, natural gas fuel was added as an enrichment fuel for comparison to Runs A and C wherein no enrichment fuel was used. The results achieved without an enrichment fuel are of substantial benefit to a carbon black process.

What is claimed is:

1. The method of burning a very lean gas including the steps of mixing the lean gas with an oxidant gas, flowing all of the mixed gases through a plurality of slots defined between a plurality of parallel positioned elongate members to establish a plurality of plane parallel jets issuing from the slots, and igniting the mixed gases flowing from said slots.

2. The method according to claim 1 including the step of streams to assure uniform distribution to said slots.

dividing the flow of mixed gases into a plurality of

3. The method of drying carbon black pellets utilizing wet lean gases discharged from the carbon black furnace including the steps of delivering the wet carbon black pellets to a dryer, mixing an oxidant gas with the wet lean gas, flowing all of the mixed gases through a plurality of slots defined between a plurality of parallel positioned elongate members to establish a plurality of plane parallel jets issuing from the slots, igniting the gases passing from said slots, and flowing the products of combustion to said dryer to dry said wet carbon black pellets.

4. An apparatus for burning lean gas comprising a housing, a plurality of parallel bars spaced apart to provide a plurality of slots having substantially parallel side walls to provide a substantially constant flow area therethrough, an inlet into said housing for delivering lean gas and oxidant gas, means for igniting lean gas and oxidant gas passing from said slots, said bars being positioned in said housing so that all of the lean gas and oxidant gas delivered to said housing flows through said slots, said housing defining a combustion chamber on the ignition means side of said bars.

5. An apparatus according to claim 4 wherein the slot to pitch ratio of said bars being substantially in the range from nine to nineteen percent.

6. An apparatus according to claim 4 including means for uniformly distributing flow of gases to said slots.

7. An apparatus according to claim 4 including means for mixing lean gas with oxidant gas, and means for delivering mixed gases from said mixing means to said housing inlet.

8. The combination with a dryer for drying carbon black pellets comprising a dryer housing, a rotary drum within the housing, a burner connected to deliver hot combustion gases into the dryer housing to heat carbon black pellets within the rotary drum, said burner having a plurality of parallel, spaced-apart elongate members defining a plurality of slots through which all of the gases to be burned flow to establish a plurality of plane parallel jets issuing from the slots, means for delivering lean off gases from the carbon black reactor to said burner mixed with an oxidant gas, and means for igniting gases exiting from said slots.

9. The method according to claim 1 wherein the sides of the said slots are defined by the parallel sides of the elongate members to provide a flow path for the mixed gases of substantially constant cross-sectional area.

10. An apparatus according to claim 4 wherein said parallel bars are metallic.

* * * * *